US005927162A

United States Patent [19]

Huang

[11] Patent Number: 5,927,162

[45] Date of Patent: Jul. 27, 1999

[54] TOOL HAVING AN ADJUSTABLE DRIVING STEM

[76] Inventor: Yung Hsu Huang, No.10, Lane 38, Li Der Street, Taiping City, Taichung Hsien, Taiwan

[21] Appl. No.: 08/988,767

[22] Filed: Dec. 11, 1997

[51] Int. Cl.[6] ..... B25B 13/16

[52] U.S. Cl. ..... 81/177.8; 81/177.4; 81/490

[58] Field of Search ..... 81/177.4, 177.8, 81/177.9, 450, 490

[56] References Cited

U.S. PATENT DOCUMENTS

| | | | |
|---|---|---|---|
| 5,174,178 | 12/1992 | Disston | 81/490 |
| 5,217,116 | 6/1993 | Ku | 81/177.4 X |
| 5,329,834 | 7/1994 | Wong | 81/177.8 X |
| 5,421,225 | 6/1995 | Chen | 81/177.4 X |
| 5,499,562 | 3/1996 | Feng | 81/490 X |
| 5,515,754 | 5/1996 | Elkins | 81/177.9 |
| 5,737,982 | 4/1998 | Lin | 81/177.9 X |
| 5,799,552 | 9/1998 | Curtis | 81/490 |

*Primary Examiner*—James G. Smith

[57] ABSTRACT

A tool includes a handle and a coupler secured to the handle. The coupler includes a number of surfaces formed in the peripheral portion. A driving stem has one end rotatably secured to the coupler and includes an outer thread for threadedly engaging with a control ferrule which may engage with the surfaces of the coupler for securing the driving stem to the coupler and to the handle. The handle includes a number of orifices for engaging with tool bits and sockets, and a cap rotatably secured to the handle. The cap has a puncture for engaging with and removing the tool bits.

7 Claims, 5 Drawing Sheets

TOOL HAVING AN ADJUSTABLE DRIVING STEM

BACKGROUND OF THE INVENTION

1. Field of the Invention

The present invention relates to a tool, and more particularly to a tool having an adjustable driving stem.

2. Description of the Prior Art

Typical tools, such as screw drivers, wrenches, comprise a driving stem secured to a handle. Some of the driving stems may be rotated relative to the handle for adjusting to different angular position relative to the handle and for allowing the tool to be easily engaged with the fasteners to be driven. However, the driving stem may not be stably retained in place.

The present invention has arisen to mitigate and/or obviate the afore-described disadvantages of the conventional tools.

SUMMARY OF THE INVENTION

The primary objective of the present invention is to provide a tool which includes a driving stem that may be adjusted to different angular position relative to the handle and that may be solidly secured in place relative to the handle.

The other objective of the present invention is to provide a tool which includes a handle having a tool bit receiving mechanism.

In accordance with one aspect of the invention, there is provided a toot comprising a handle including a first end having a hole, a coupler including a protrusion engaged in the hole of the handle for allowing the coupler to be secured to the handle, the coupler including a peripheral portion having a plurality of surfaces, a driving stem including a first end rotatably secured to the coupler at a pivot shaft and including an outer thread formed on the first end, and a control ferrule threadedly engaged with the outer thread of the driving stem for engaging with the surfaces of the coupler and for securing the driving stem to the coupler and to the handle, and for allowing the driving stem to be adjusted and secured to the handle at an angular position relative to the handle.

A disc is secured on the driving stem and includes a plurality of cavities for engaging with tool bits and sockets. The driving stem includes a stud formed in the first end of the driving stem, the coupler includes a positioning means for positioning the driving stem to the coupler. The stud of the driving stem includes at least one depression, the positioning means includes a spring biased projection for engaging with the at least one depression of the stud arid for securing the driving stem to the coupler.

In accordance with another aspect of the invention, there is provided a tool comprising a driving stem, and a handle secured to the driving stem for actuating the driving stem, the handle including a plurality of orifices for engaging with tool bits and sockets, the orifices being arranged in a circle having a center, a cap including a pole rotatably secured to the handle at the center of the circle, the cap including a puncture for aligning with the orifices and for allowing the tool bits and the sockets to be engaged into and disengaged from the handle.

A positioning means is further provided for positioning the cap to the handle. The handle includes a recess communicating with the orifices for rotatably receiving the cap. The handle includes a plurality of depressions, the cap includes a jut for engaging with the depressions and for positioning the cap to the handle.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
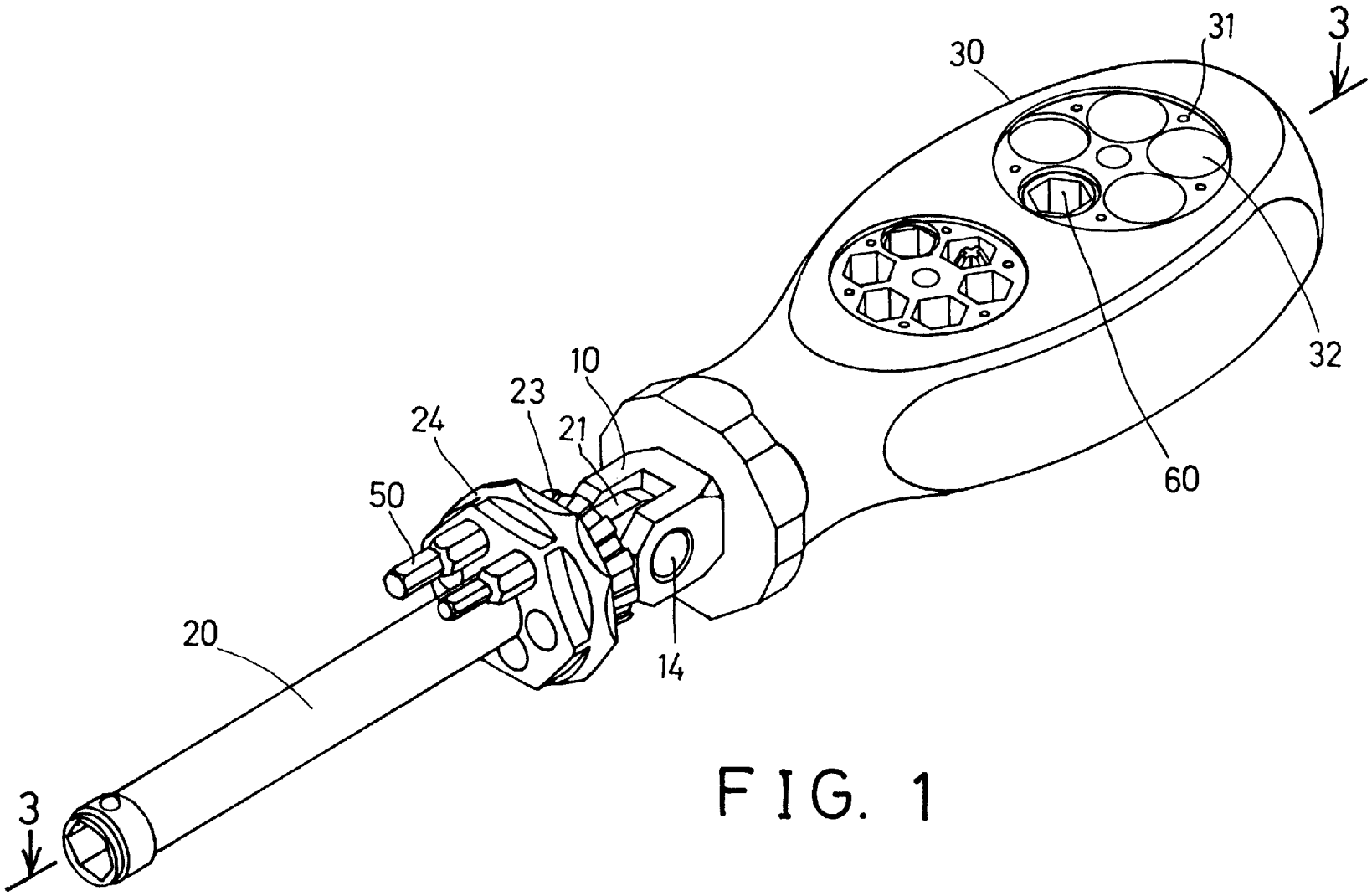
FIG. 1 is a perspective view of a tool in accordance with the present invention.
Figure 2:
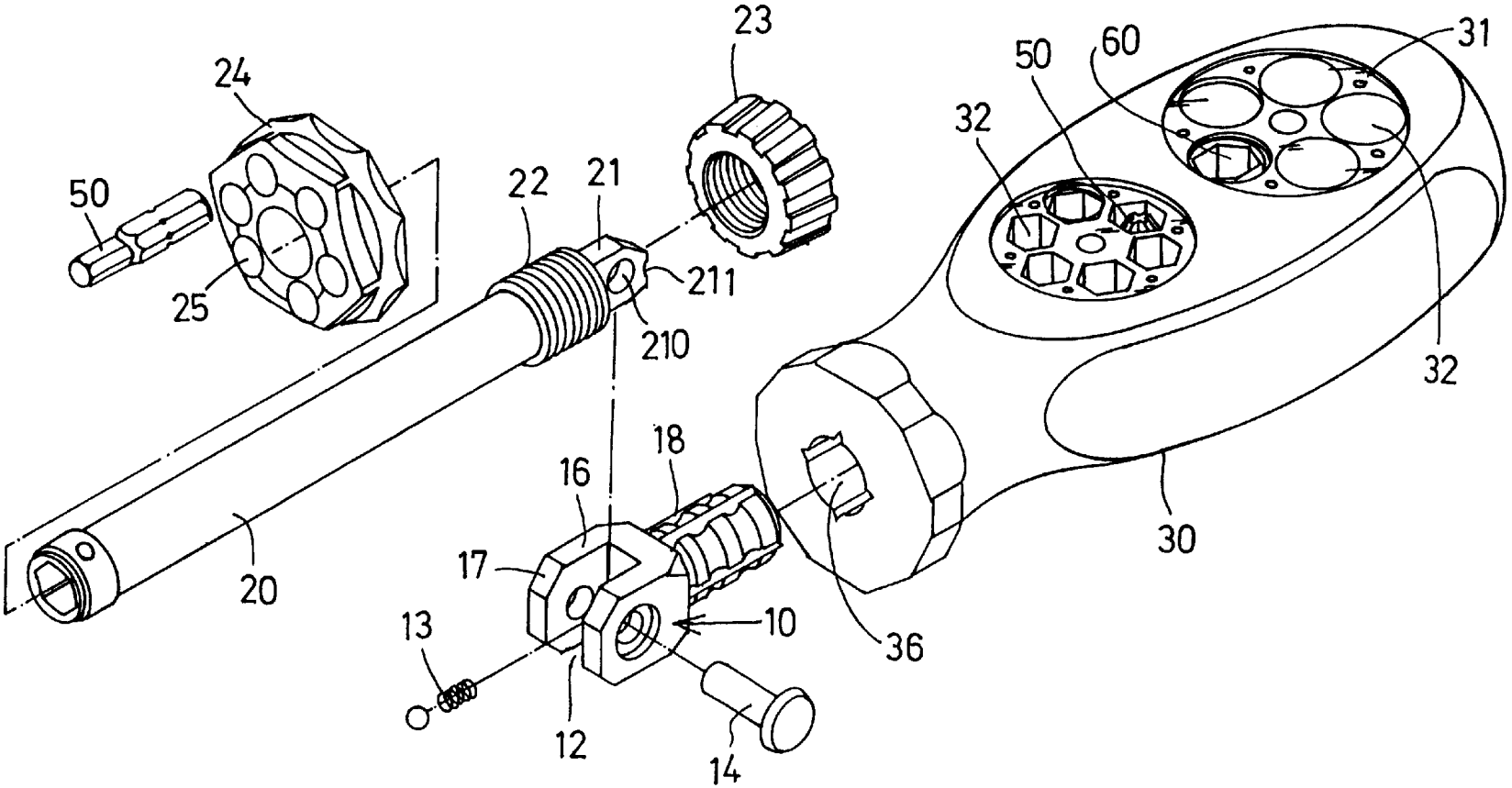
FIG. 2 is a partial exploded view of the tool.
Figure 3:
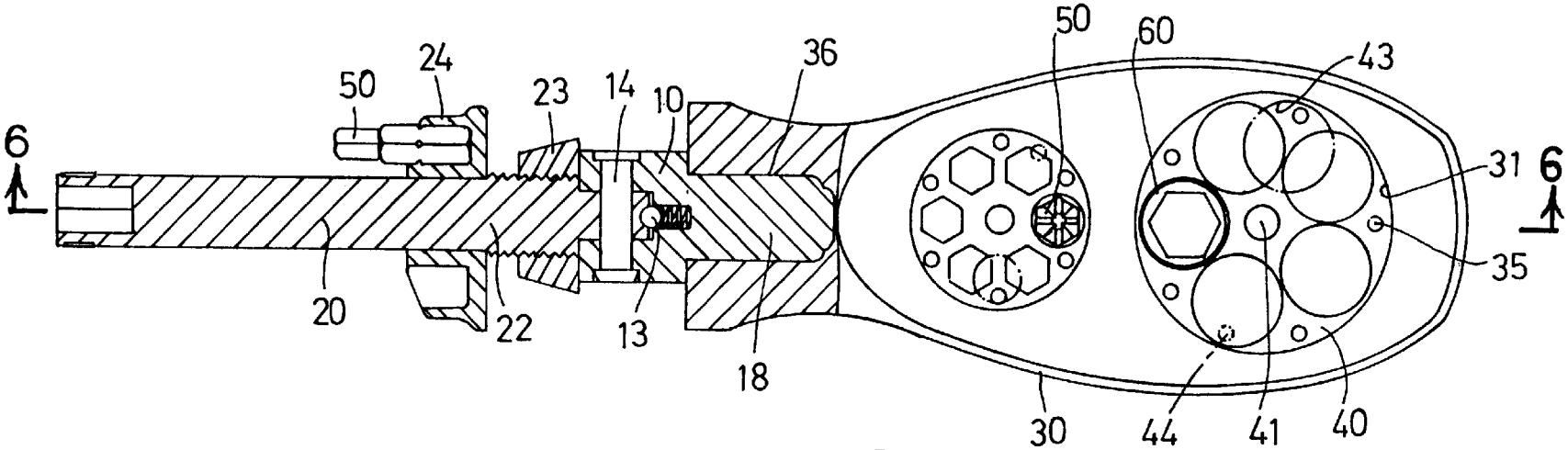
FIG. 3 is a partial cross sectional view taken along lines 3—3 of FIG. 1.

Referring to the drawings, and initially to FIGS. 1–3, a tool in accordance with the present invention comprises a handle 30 including a hole 36 formed in one end. A coupler 10 includes a protrusion 18 engaged in the hole 36 of the handle 30 and includes a pair of fins 16 having a gap 12 formed between the fins 16. A shaft 14 is engaged through the fins 16. The fins 16 each include three or more surfaces 17 formed in the peripheral portion. The coupler 10 includes a spring biased projection 13 slightly extended inward of the gap 12 (FIG. 3).

Figure 6:
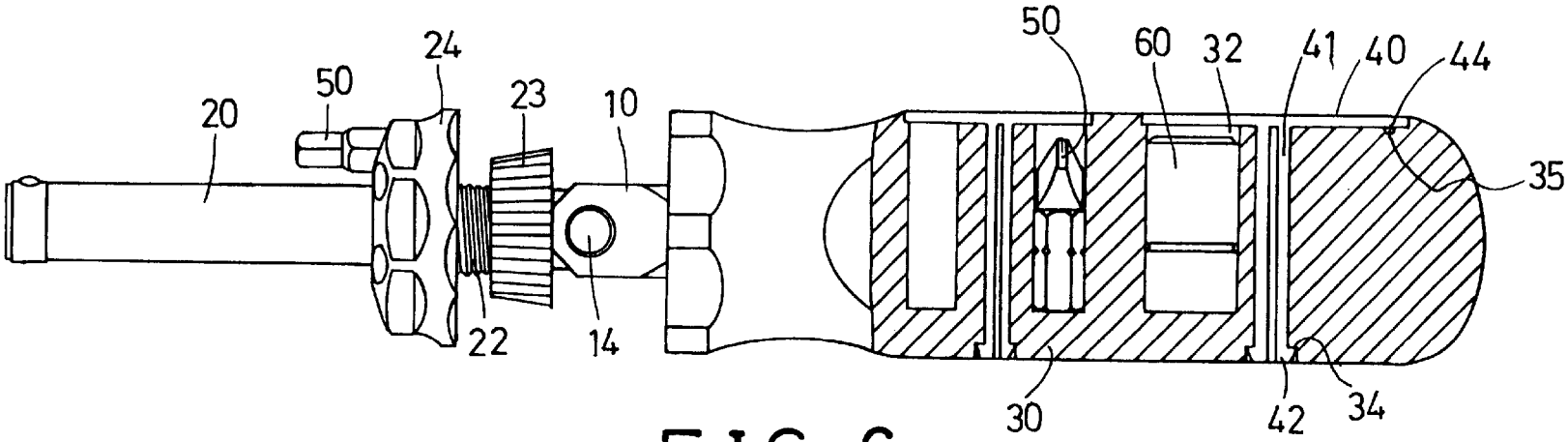
FIG. 6 is a partial cross sectional view taken along lines 6—6 of FIG. 3.
Figure 4:
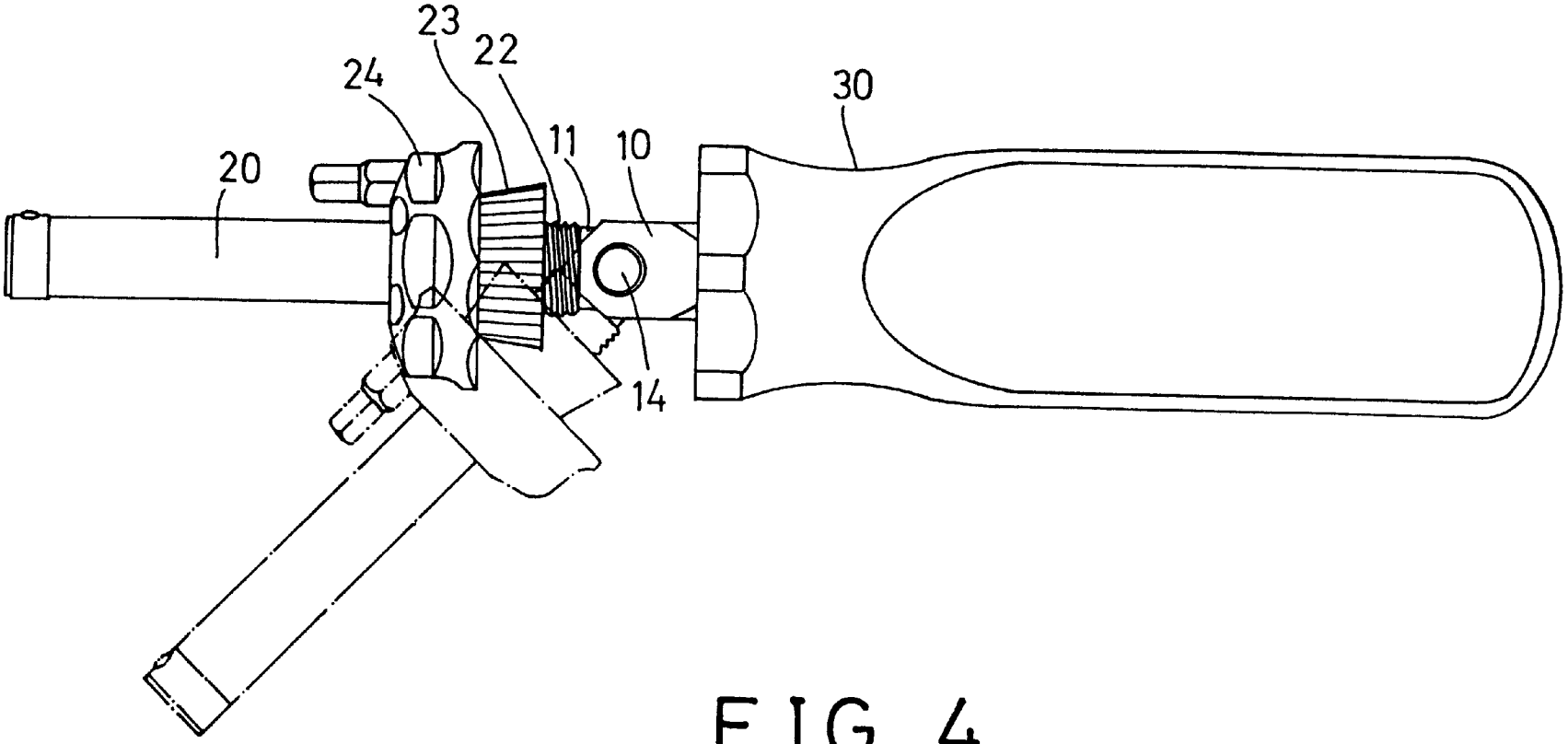
FIG. 4 is a plane view illustrating the operation of the tool.

A driving stem 20 includes a stud 21 engaged in the gap 12 of the coupler 10 and having a hole 210 for engaging with the shaft 14 and for allowing the driving stem 20 to be rotated relative to the coupler 10. The stud 21 includes one or more depressions 211 for engaging with the spring biased projection 13 which may position the driving stem 20 at a suitable angular position relative to the handle 30. The driving stem 20 includes an outer thread 22 formed in one end close to the stud 21 for threadedly engaging with a control ferrule 23 which may engage with either of the surfaces 17 in order to secure the driving stem 20 to the coupler 10 (FIG. 6). A disc 24 is secured on the driving stem 20 by such as force-fitted engagement or by welding process and includes a number of cavities 25 for engaging with tool bits 50. The disc 24 may also be rotatably secured on the driving stem 20 and may be provided for engaging with the ferrule 23 (FIG. 4) and for preventing the ferrule 23 from being disengaged from the outer thread 22.

Figure 5:
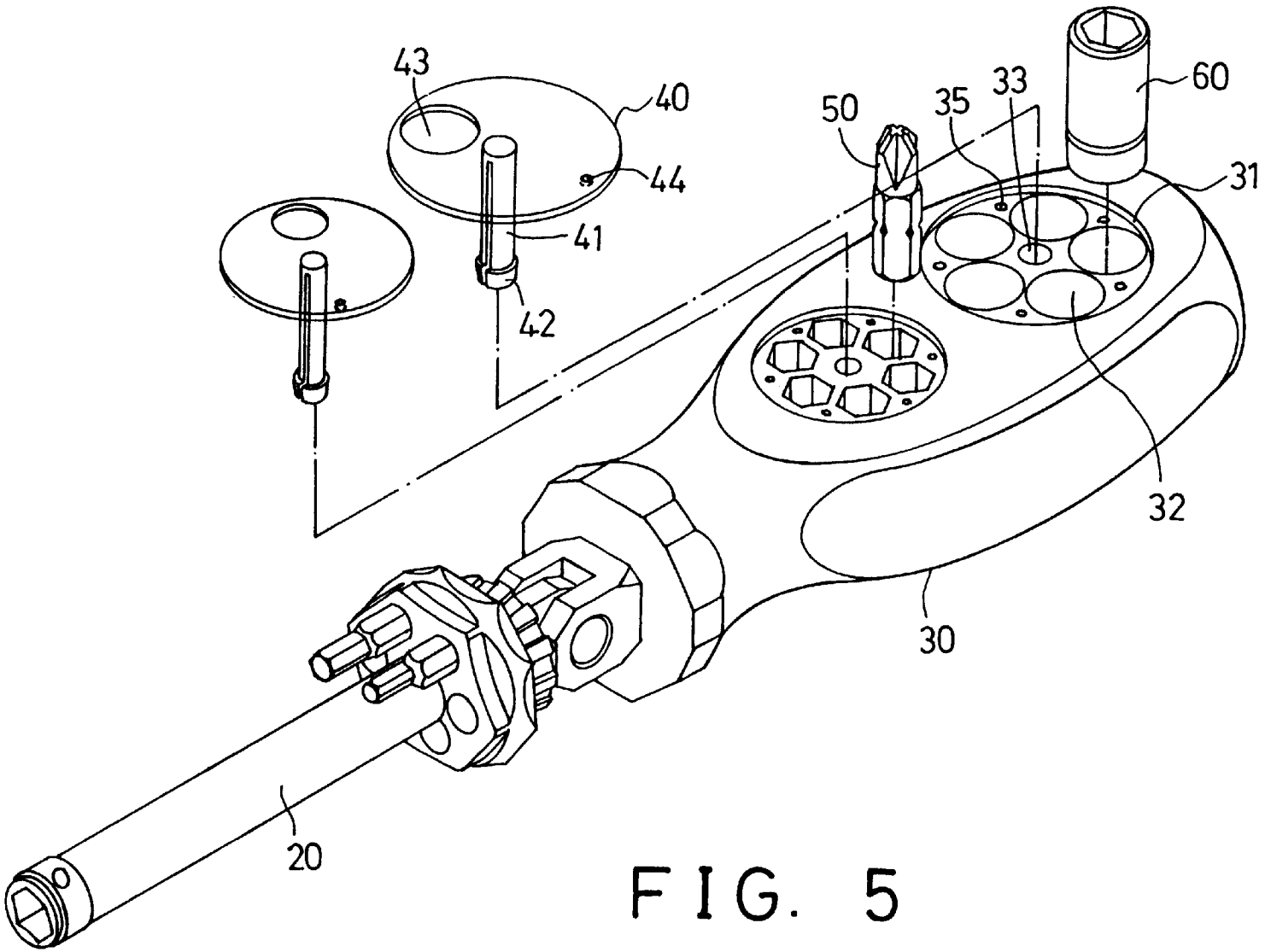
FIG. 5 is a partial exploded view of the tool.

Referring next to FIGS. 5 and 6, and again to FIG. 3, the handle 30 includes one or more recesses 31 and a number of orifices 32 for engaging with tool bits 50 or sockets 60 or similar articles. The recesses 31 are communicating with the orifices 32 and preferably arranged in a circle. The handle 30 includes one or more apertures 33 each being formed in the center of the recess 31 and includes a number of depressions 35. One or more caps 40 each includes a pole 41 engaged in the aperture 33 of the handle 30 and each includes a latch 42 for engaging with a shoulder 34 (FIG. 6) of the handle 30 and for allowing the cap 40 to be easily and rotatably secured to the handle 30. The caps 40 are rotatably engaged in the recesses 31. The caps 40 each includes a puncture 43 for aligning with the orifices 32 and for engaging with or for removing the tool bits 50 or sockets 60 from the orifices 32 of the handle 30. The caps 40 each includes a jut 44 for engaging with the depressions 35 and for positioning the cap 40 in place relative to the handle 30.

For allowing the tool bits 50 and the sockets 60 to be seen, it is preferable that the caps 40 are made of transparent material, such that the user may easily find the required tool bits 50 or sockets 60. The cap 40 may be easily rotated by engaging the finger or the tool bit with the puncture 43. As shown in dotted lines in FIG. 3, when the puncture 43 is not aligned with either of the orifices 32, all of the tool bits 50 or sockets 60 may be retained in place and will not be disengaged from the handle 30.

Accordingly, the tool in accordance with the present invention includes a driving stem which may be adjusted to different angular position relative to the handle and which may be solidly secured in place relative to the handle.

The other objective of the present invention is to provide a tool which includes a handle having a tool bit receiving mechanism.

Although this invention has been described with a certain degree of particularity, it is to be understood that the present disclosure has been made by way of example only and that numerous changes in the detailed construction and the combination and arrangement of parts may he resorted to without departing from the spirit and scope of the invention as hereinafter claimed.

I claim:

1. A tool comprising:

a driving stem, and a handle secured to said driving stem for actuating said driving stem, said handle including a plurality of orifices for engaging with tool bits and sockets, said orifices being arranged in a circle having a center, a cap including a pole rotatably secured to said handle at said center of said circle, said cap including a puncture for aligning with said orifices and for allowing said tool bits and said sockets to be engaged into and disengaged from said handle, and said handle including a recess communicating with said orifices for rotatable receiving said cap.

2. The tool according to claim 1 further comprising means for positioning said cap to said handle.

3. The tool according to claim 1, wherein said handle includes a first end having a hole, said tool further includes a coupler having a protrusion engaged in said hole of said handle for allowing said coupler to be secured to said handle, said coupler includes a peripheral portion having a plurality of surfaces, said driving stem includes a first end rotatably secured to said coupler at a pivot shaft and includes an outer thread formed on said first end, and said tool further includes a control ferrule threadedly engaged with said outer thread of said driving stem for engaging with said surfaces of said coupler and for securing said driving stem to said coupler and to said handle, and for allowing said driving stem to be adjusted and secured to said handle at an angular position relative to said handle.

4. The tool according to claim 1 further comprising a disc secured on said driving stem, said disc including a plurality of cavities for engaging with tool bits and sockets.

5. The tool according to claim 3, wherein said driving stem includes a stud formed in said first end of said driving stem, said coupler includes a positioning means for positioning said driving stem to said coupler.

6. The tool according, to claim 5, wherein said stud of said driving stem includes at least one depression, said positioning means includes a spring biased projection for engaging with said at least one depression of said stud and for securing said driving stem to said coupler.

7. A tool comprising:

a driving stem, and a handle secured to said driving stem for actuating said driving stem, said handle including a plurality of orifices for engaging with tool bits and sockets, said orifices being arranged in a circle having a center, a cap including a pole rotatably secured to said handle at said center of said circle, said cap including a puncture for aligning with said orifices and for allowing said tool bits and said sockets to be engaged into and disengaged from said handle, said handle including a plurality of depressions, said cap including a jut for engaging with said depressions and for positioning said cap to said handle.

* * * * *